United States Patent [19]

Ueda et al.

[11] Patent Number: 4,462,013

[45] Date of Patent: Jul. 24, 1984

[54] ELECTROMAGNETIC DEVICE WITH DUST-TIGHT ENCLOSURE

[75] Inventors: Hiroshi Ueda, Nara; Shigeru Oyokota, Sakai, both of Japan

[73] Assignee: Minolta Camera Kabushiki Kaisha, Osaka, Japan

[21] Appl. No.: 141,611

[22] Filed: Apr. 15, 1980

Related U.S. Application Data

[63] Continuation-in-part of Ser. No. 950,518, Oct. 11, 1978, abandoned.

[30] Foreign Application Priority Data

Oct. 13, 1977 [JP] Japan ..... 52-121839
Aug. 25, 1978 [JP] Japan ..... 53-104246

[51] Int. Cl.[3] ..... H01F 7/08

[52] U.S. Cl. ..... 335/229; 335/234; 335/260

[58] Field of Search ..... 335/234, 230, 229, 236, 335/260

[56] References Cited

U.S. PATENT DOCUMENTS 3,755,766 8/1973 Read, Jr. ..... 335/229

*Primary Examiner*—Harold Broome
*Attorney, Agent, or Firm*—Wenderoth, Lind & Ponack

[57] ABSTRACT

An electromagnetic device which comprises an excitation coil wound to assume a substantially cylindrical shape having an axially extending hollow space; a plunger made of a magnetic material accomodated within the hollow space for movement in an axial direction of the excitation coil between retracted and projected positions; yoke means made of a magnetic material and engageable with one end of the plunger to provide a magnetic path which may be interrupted in response to the movement of the plunger towards the projected position, said yoke means extending between the respective ends of the excitation coil and positioned external of the said excitation coil to provide a closed magnetic circuit including the plunger and the magnetic path; a permanent magnet made of intermetallic compounds of cobalt and one more rare earth elements disposed in the closed magnetic circuit so as to develop a magnetic force of attraction attracting the plunger onto the end of the yoke means opposed to the end of the plunger and holding the plunger in the retracted position, said magnetic force of attraction being substantially cancelled by a magnetic force of the excitation coil when the excitation coil is energized; and means for covering the respective ends of the plunger and the yoke means so as to prevent powdered magnetic material from adhering to the respective ends of the plunger and the yoke means.

30 Claims, 28 Drawing Figures

*Fig. 1* (PRIOR ART)
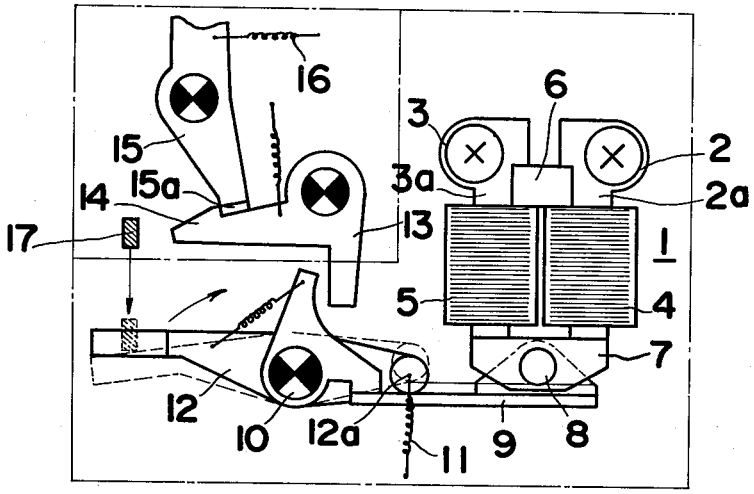
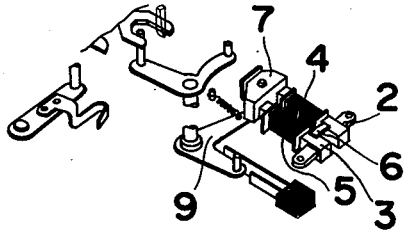
*Fig. 2* (PRIOR ART)
*Fig. 3*
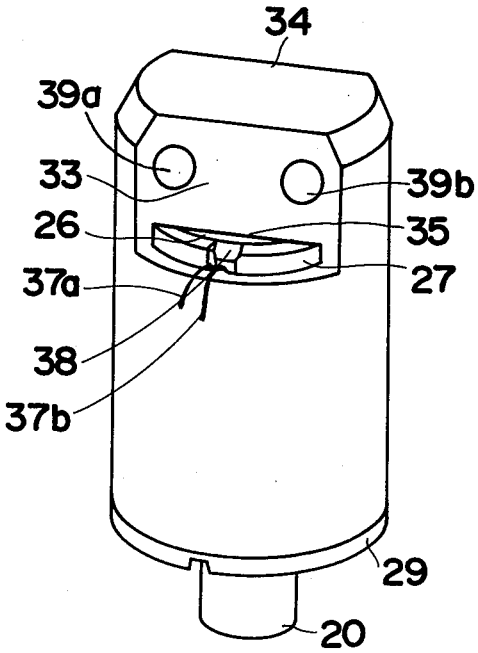
*Fig. 4*
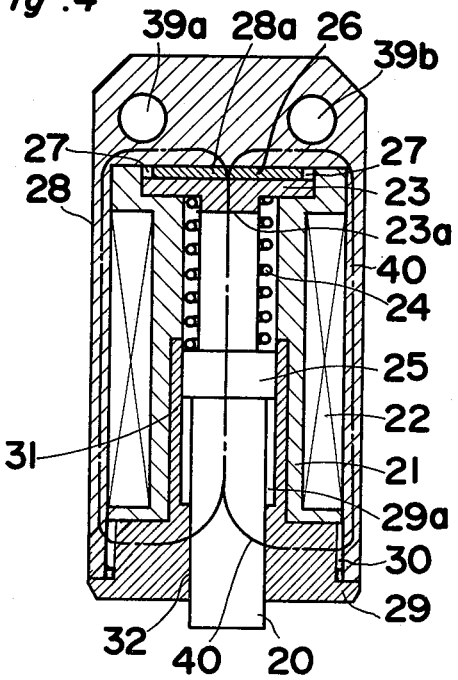

ELECTROMAGNETIC DEVICE WITH DUST-TIGHT ENCLOSURE

This is a continuation-in-part application of our copending application Ser. No. 950518 filed on Oct. 11, 1978, now abandoned.

The present invention relates to an electromagnetic device, and particularly to an improvement of an electromagnetic device comprising a permanent magnet provided normally to attract a moving armature and excitation coil which serves to develop magnetic flux cancelling the magnetic force of the permanent magnet so as to release the moving armature from its attracted position when the excitation coil is energized.

In a conventional camera, for example, in a single lens reflex camera, an electromagnet with a U shaped yoke is often employed to operate a shutter driving mechanism or an exposure control mechanism.

The conventional electromagnet of the kind mentioned above attracts a moving armature onto the U shaped yoke when an excitation coil is energized, and, on the other hand, the moving armature is released from the fixed yoke by a spring when the excitation coil is deenergized. Thus, when such an electromagnet is employed, electric power must be continuously supplied to the excitation coil to keep the moving armature on the fixed yoke. This causes excessive consumption of electric power. In order to avoid this problem, in some kinds of exposure control mechanism having an electromagnet of the above type, a driving member is engaged in a given state by means of a mechanical engaging arrangement during deenergization of the excitation coil. In order to operate the shutter driving mechanism, the excitation coil is energized so as to disengage the driving member from said engaged position by an attraction movement of the moving armature onto the U shaped yoke. Thereafter, the excitation coil is again deenergized under the control of a control circuit so as to release the moving armature from the U shaped yoke.

As is apparent from the foregoing, the conventional electromagnet has such drawbacks that a shutter mechanism or an exposure control mechanism is complicated in construction when it is employed in a camera.

In order to avoid the drawbacks, it has been proposed to use in a single lens reflex camera an electromagnetic device having a permanent magnet.

An example of a conventional electromagnetic device of the kind is shown in FIG. 1.

Referring to FIG. 1, a U shaped electromagnetic device 1 includes a pair of fixed yokes 2 and 3, having respective excitation coils 4 and 5 formed thereon, and a permanent magnet 6 provided between the fixed yokes 2 and 3 with reversed polarity relative to the excitation coils 4 and 5. Both arms 2*a* and 3*a* of the fixed yokes 2 and 3 are fixed to a housing. A moving armature 7 is rotatably mounted on a pin 8 carried by a retaining lever 9 pivotable about a fixed axis 10. Said retaining lever 9 is biased clockwise about the fixed axis 10 by a spring 11, the biasing force of the spring 11 being transmitted to said lever 9 through a pin member 12*a* carried by a lever 12 pivotable about the fixed pin 10 independently of the pivotal movement of the lever 9. It is to be noted that the biasing force of the spring 11 transmitted to the lever 9 is smaller than the magnetic force of attraction acting from the permanent magnet to the moving armature 7 through the yokes 2 and 3 when the coils 4 and 5 are not energized.

In operation, when a current flows through the excitation coils 4 and 5 to energize the latter, the magnetic force of the magnet 6 is weakened and, therefore, the moving armature 7 is disengaged from the fixed yokes 2 and 3 by the spring 11. This causes the lever 9 to rotate clockwise about the fixed axis 10 whereby an electric signal used to energize the coil 4 and 5 is translated into a mechanical signal used to rotate the retaining lever 9.

The rotation of the lever 9 is transmitted to an engaging lever 13 to rotate counterclockwise causing a hook 14 to disengage from a rising part 15*a* of a driving lever 15. Thus, the driving lever 15 is allowed to rotate clockwise by a spring 16 so that the driving lever 15 drives a shutter mechanism (not shown) in a camera in the known manner.

When the excitation coils 4 and 5 are deenergized and a reset member 17 is operated downward, the lever 12 and 9 rotate counterclockwise, so that the moving armature 7 is attracted onto the fixed yokes 2 and 3.

U.S. Pat. No. 4,062,028 discloses an application of the electromagnetic device of the kind in a single lens reflex camera as shown partly in FIG. 2. The arrangement shown therein is substantially similar to that shown in FIG. 1, and therefore like parts are designated by same reference numerals and details thereof are omitted.

The conventional electromagnetic device as shown in FIG. 1 or FIG. 2 has a drawback that each end face of the yokes 2 and 3 which contacts the moving armature 7 is exposed to the ambient atmosphere, and therefore, when the moving armature 7 separates from the yoke 2 and 3 during deenergization of the coils, magnetizable particles contained in the dust present near the yokes are attracted onto the end faces of the yokes by the magnetic attractive force of the permanent magnet.

Eventually, the magnetic force of the yokes attracting the moving armature 7 tends to weaken very much even while the moving armature 7 is contacting the yokes.

In order to eliminate the drawbacks, the conventional electromagnetic device of this type requires a dust-proof cover for covering the device as a whole.

However, it is difficult not only to cover the electromagnetic device completely but also to assemble such an electromagnetic device having a dust-proof cover in a camera. In addition, to provide such a dust-proof cover makes the electromagnetic device and the camera bulky.

The conventional electromagnetic device of this type has another drawback as hereinafter explained. The conventional device has two yokes 2 and 3 fixed separately one on each of the sides of the permanent magnet 6. Thus, it is difficult to align both contact surfaces of the yokes 2 and 3 on a common plane. In addition, guide means must be provided to prevent the plane of rotation of the retaining lever 9 holding the moving armature 7 from inclining relative to a plane at right angles to the contact surfaces of the yokes 2 and 3. The provision of such guide means complicates the electromagnetic device.

Accordingly, an essential object of the present invention is to provide an electromagnetic device of the dust-proof type in which the electromagnetic mechanism is assembled into a compact module so that the contact surfaces of a yoke and a moving armature composed of a plunger are advantageously shielded from the ambient atmosphere.

Another object of the present invention is to provide an electromagnetic device employing only one fixed yoke adapted to magnetically attract a plunger, thereby enabling the yoke to exert an increased attractive force and also enabling the device to be readily assembled.

These and other objects and the features of the present invention will become apparent from the following description of the present invention with reference to the accompanying drawings in which;

FIG. 1 is a plan view showing on example of a conventional electromagnetic device having a permanent magnet;

FIG. 2 is a perspective view showing another example of a conventional electromagnetic device having a permanent magnet;

FIG. 3 is a perspective view showing a first embodiment of an electromagnetic device according to the present invention;

FIG. 4 is a cross sectional view showing the first embodiment of the electromagnetic device wherein a plunger is at a retracted position;

Before the description proceeds, it is noted that like parts are designated by like reference numerals throughout the accompanying drawings and the permanent magnet employed in the various embodiments described hereinafter is made of a rare earth group material as designated hereinafter.

Figure 5:
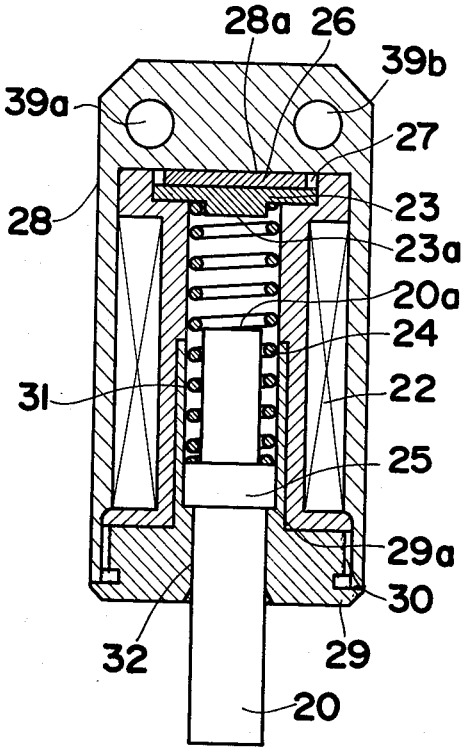
FIG. 5 is a cross sectional view showing the first embodiment wherein a plunger is at a projected position.

Referring to FIGS. 3, 4 and 5, a cylindrical plunger 20 made of a magnetic material is slidably inserted within a cylindrical space of a hollow bobbin 21 of synthetic resin having an excitation coil 22 wound therearound. The plunger 20 has a contact surface 20*a* at its top end which contacts a bottom face 23*a* of a fixed yoke piece or armature 23 fitted in the adjacent end space of the bobbin 21.

A compression spring 24 is constrained between the fixed armature 23 and enlarged portion 25 defined at a substantially intermediate portion of the plunger 20 and serves to urge the plunger 20 in a direction away from the bottom face 23*a* of the fixed armature 23.

A disc shaped permanent magnet 26 surrounded by a spacer ring 27 is stacked on the upper face of the fixed armature 23 and placed within an enlarged end portion of the bobbin 21.

The permanent magnet 26 is a so-called rare earth cobalt permanent magnet which is made of an intermetallic compound or a cobalt base compound given by the formula $RC_{o5}$ where R is a member selected from the group consisting of Y and at least one of the rare earth elements (lanthanide metals) such as La, Ce, Pr, Nd, Pm, Sm, Gd, Tb, Dy, Ho, Er, Tm and Lu.

A rare earth cobalt permanent magnet has a property by which its remanence recovers completely after it is placed in a magnetic field of opposite polarity.

The bobbin 21 and other components accomodated therein are enclosed by a cylindrical fixed yoke 28 made of magnetic material, the inner bottom surface 28*a* of which contacts the upper surface of the permanent magnet 26.

A guide yoke 29 of magnetic material is secured by means of screws 30 to one end of the cylindrical fixed yoke 28 so as to close the opening of the fixed yoke 28. The yoke piece or armature 23, the fixed yoke 28 and the guide yoke 29 together constitute yoke means.

A guide cylinder 31 protruding from the guide yoke 29 extends along the internal surface of the bobbin 21 up to the middle thereof.

The plunger 20 slidably extends through the guide yoke 29 by way of an opening 32.

On both sides of the outer periphery of the upper end portion of the cylindrical fixed yoke 28, there are formed plane surfaces 33 and 34 and elongated slots 35 and 36 (not shown) communicating with the interior of the cylindrical fixed yoke 28. The opposed portions of the periphery of the fixed armature 23 and the corresponding peripheral portions of the spacer ring 27 are exposed through the slots 35 and 36 to the outside of the fixed yoke 28.

A pair of lead wires 37*a* and 37*b* extending from respective ends of the exitation coil 22 are led out through the gap 38 defined in a part of the spacer ring 27.

A pair of perforated holes 39*a* and 39*b* are provided in the plane part of the cylindrical fixed yoke 28, which are used to secure the device to a suitable member or support (not shown) by means of screws passed through the holes 39*a* and 39*b*.

In the electromagnetic device as described above, when and so long as the excitation coil 22 is deenergized, the magnetic flux developed by the permanent magnet 26 flows on the path 40 defined via the cylindrical fixed yoke 28, guide yoke 29 and the plunger 20, so that the plunger 20 is attracted onto the fixed armature 23 against the force of the spring 24.

On the other hand, when the excitation coil 22 is energized by a current flowing therethrough, the magnetic flux developed by the permanent magnet 26 is so cancelled by a magnetic flux developed by the excitation coil 22 that the magnetic motive force provided at the fixed armature 23 is weakened. Thus, the plunger 20 is disengaged from the fixed armature 23 and urged away from the fixed armature 23 by the action of the spring 24 until the bottom end of the enlarged portion 25 engages the upper shoulder 29*a* of the guide yoke 29. Thus, the plunger 20 can move from the retracted position to a projected position as shown in FIG. 5.

The movement of the plunger 20 as described above provides a mechanical signal corresponding to the electrical signal applied to the excitation coil 22.

After the removal of the magnetic field of the excitation coil 22, when it is deenergized the permanent magnet 26 recovers its original remanence as described above, and thus the plunger 20 is attracted onto the permanent 26 by the magnetomotive force of the permanent magnet 26.

In the example of the embodiment as described above, the spacer ring 27 may be made of magnetic material. In this case, the magnetic attractive force of the permanent magnet 26 may be partially decreased. However, it is appreciated that the plunger 20 can readily be released from the fixed armature 23 with a lesser electromagnetic motive force of the coil 22. Therefore, the plunger 20 responses rapidly to the current applied to the excitation coil 22 and the stability of the operation of the plunger 20 can be improved.

As the guide cylinder 31 of the guide yoke 29 extends far into the hollow space of the bobbin 21, the density of the magnetic flux around the contact surface between the plunger 20 and the guide cylinder 31 decreases despite the fact that the total amount of the magnetic flux remains unchanged. This causes reduction of the force attracting the plunger 20 onto the guide yoke 29 at right angles to the axial direction of the plunger 20, resulting in a reduction of the friction between the plunger and the guide yoke 29. Therefore, the force attracting the plunger 20 onto the fixed armature 23 can be increased, when the plunger 20 is at a position spaced away from the fixed armature 23.

Figure 6:
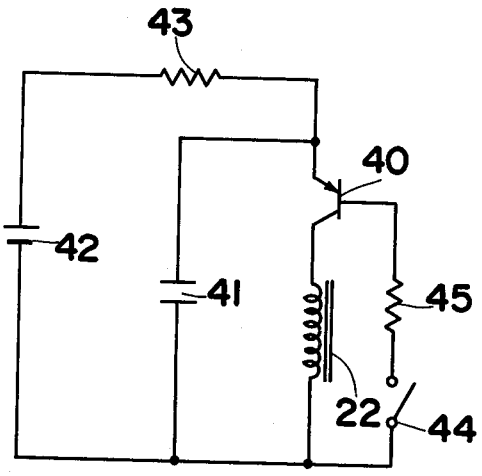
FIG. 6 is a schematic diagram showing a circuit arrangement employed for operating the electromagnetic device according to the present invention.

FIG. 6 shows an electric control circuit employed for operating the electromagnetic device as described above. In this circuit arrangement, the excitation coil 22 is connected to the collector of a transistor 40. A capacitor 41 is connected to the emitter of the transistor 40 to which the positive end of a battery 42 is connected through a resistor 43. A switch 44 is connected to the base of the transistor 40 through a resistor 45.

When and so long as the switch 44 is opened, the transistor 40 is in a non-conductive state and the capacitor 41 is charged by a current fed from the battery 42 through the resistor 43.

On the other hand, when the switch 44 is closed, the transistor 40 conducts, whereby the excitation coil 22 is energized by a discharging current of the capacitor 41, the plunger 20 being consequently pushed out by the action of the spring 24 as described above.

According to the circuit arrangement shown in FIG. 6, as the plunger 20 of the electromagnetic device operates within a relatively short period by the current fed from the capacitor 41, electric power consumed in the excitation coil 22 and the related circuit may be effectively decreased.

Figure 7:
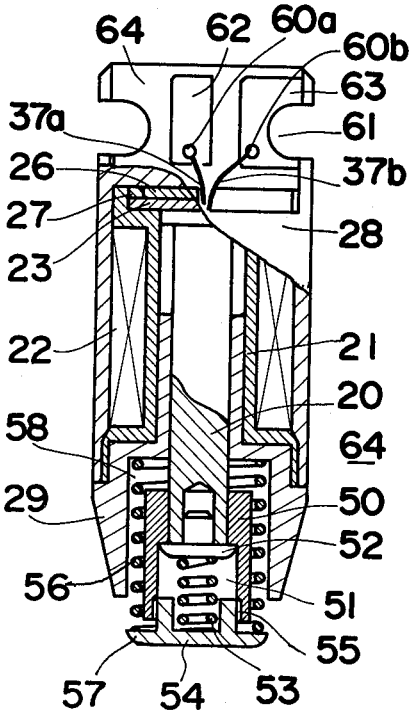
FIG. 7 is a cross sectional view showing the second embodiment of an electromagnetic device of the present invention.
Figure 8:
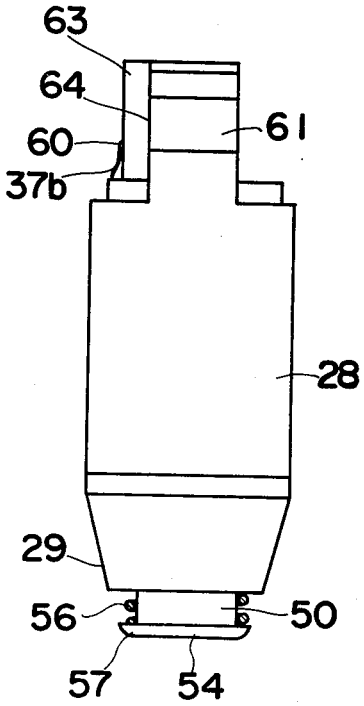
FIG. 8 is a side view of the second embodiment shown in FIG. 7.

FIGS. 7 and 8 show the second embodiment of the present invention in which an overcharge mechanism is employed.

In this embodiment, an overcharge cylinder 50 having a recess 51 defined therein is slidably mounted on the lower end portion of the plunger 20 and secured thereto by means of a screw 52 so as to avoid any possible separation of the overcharge cylinder 50 from the plunger 20.

An overcharge spring 53 accomodated in the recess 51 is constrained between the head of the screw 52 and an end plug 54 threadingly engaged at 55 to the lower end of the overcharge cylinder 50.

In a recess 58 defined in the guide yoke 29, a coil spring 56 is constrained between the bottom of the recess 58 and a flange 57 radially outwardly extending from the end plug 54 and serves to urge the plunger 20 in a direction away from the fixed armature 23, the biasing force of the spring 56 being transmitted to the plunger 20 through the overcharge cylinder 50.

In this construction, when and so long as the excitation coil 22 is not energized, the plunger 20 will be attracted onto the fixed armature 23 not only by the magnetic force of attraction of the permanent magnet 26, but also by the application of a physical force exerted by a reset member (not shown) on the end plug 54 and acting to lift the plunger 20.

If the reset member moves upwardly excessivsly beyond the upper limit of the stroke of the plunger 20 and continues to urge the end plug 54 after the plunger 20 has contacted the fixed armature 23, that is, if an overcharge operation occurs, the overcharge cylinder 50 slides upward along the plunger 20 against the forces of the overcharge spring 53 and coil spring 56. Thus, the excessive motion of the reset member beyond the upper limit of the stroke of the plunger 20, namely, the overcharge operation of the reset member, can effectively be neglected.

The slide motion of the overcharge cylinder 50 assures not only the tight engagement of the plunger 20 onto the fixed armature 23 during the reset operation of the plunger 20 but also the protection against damage to both the surface of the plunger 20 and the fixed armature 23, which may be caused by excessive motion of the reset member.

Respective free ends of the lead wires 37*a* and 37*b* of the excitation coil 22 are connected to the terminals 60*a* and 60*b* fixed on the conduction member 62 and 63 secured to the flat plane 64 formed on the upper portion of the cylindrical yoke 28.

The conduction member 63 is electrically grounded through a screw (not shown) inserted in a U shaped recess 61 and secured to a suitable body to which the electromagnetic device 64 is fixed.

The terminal 60*a* is connected to the collector of the transistor 40 shown in the FIG. 6.

The above described wiring arrangement employed in the embodiment of the FIG. 7 prevents any possible breakage of the lead wires 37*a* or 37*b* and the excitation coil 22, since the wires do not weave.

Figure 9:
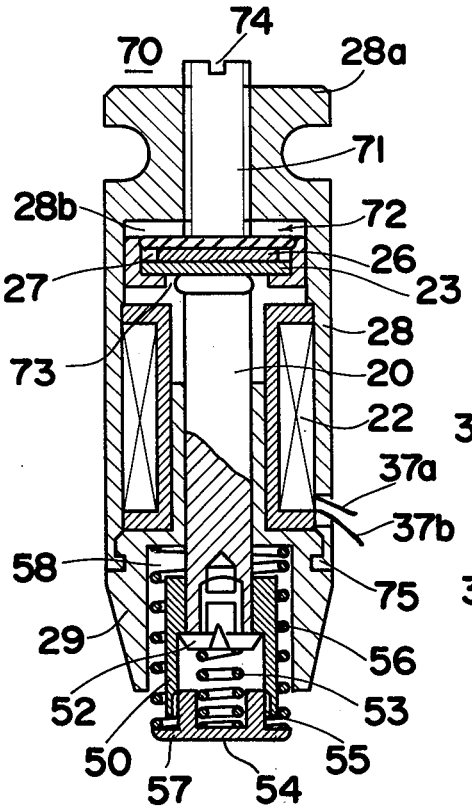
FIG. 9 is a cross sectional view of the third embodiment of an electromagnetic device of the present invention.
Figure 10:
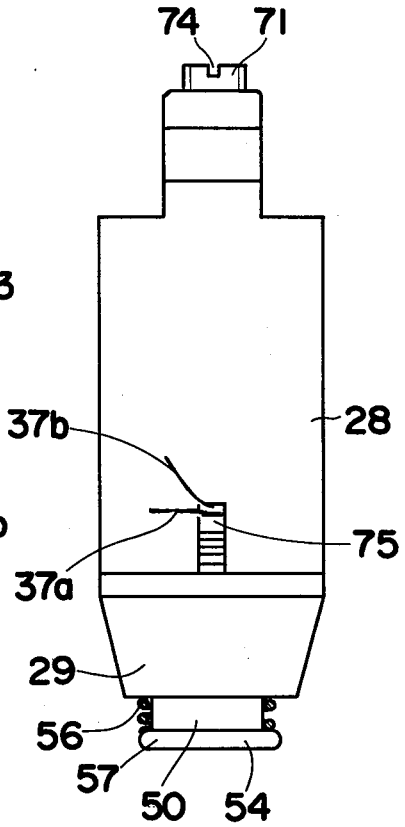
FIG. 10 is a side view of the third embodiment shown in FIG. 9.

FIGS. 9 and 10 show a third embodiment of an electromagnetic device according to the present invention in which an adjusting means for positioning the plunger at a desired position is employed.

The adjusting means 70 include a set screw 71 threadingly extending through the top portion 28*a* of the cylindrical yoke 28, and a retaining member 72 made of magnetic material slidably accomodated in the space 28*b* of the cylindrical yoke 28 and integrally connected to the bottom face of the set screw 71. The retaining member 72 embraces the permanent magnet 26 with the spacer ring 27 and the fixed armature 23 and holds them in the interior thereof.

An opening 73 is defined in the bottom portion of the retaining member 72 so that the plunger 20 can be attracted and engaged onto the bottom of the fixed armature 23.

In this embodiment, when the screw 71 is turned by the use of a screw driver engaged in a slot 74 formed at the top of the screw 71, the retaining member 72 is displaced in an axial direction of the plunger along the inner surface of the cylindrical yoke 28. Thus, the upper limit of the stroke of movement of the plunger 20 i.e., the retracted position can be adjusted.

As shown in FIGS. 9 and 10, respective free ends of the lead wires 37*a* and 37*b* of the excitation coil 22 are led out through a gap 75 defined in the lower side of the cylindrical yoke 28, because the gap 38 provided in the embodiments of FIG. 3 or 7 is covered by the retaining member 72. However, the wiring arrangement shown in FIGS. 9 and 10 provides a dust-proof arrangement as to the contact surface of the plunger 20 and the fixed armature 23.

In each of the embodiments described above, the electric circuit arrangement shown in FIG. 6 for operating the electromagnetic device may be arranged within the cylindrical yoke 28, thereby facilitating integration of the device.

Figure 11:
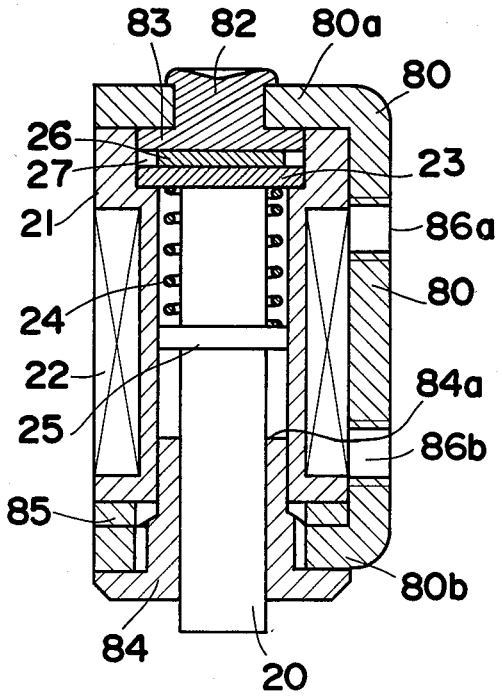
FIG. 11 is a cross sectional view of the fourth embodiment of an electromagnetic device of the present invention.
Figure 12:
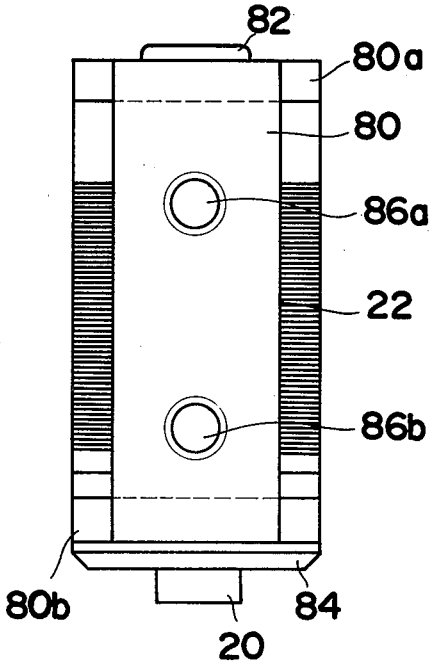
FIG. 12 is a side view of the fourth embodiment shown in FIG. 11.
Figure 13:
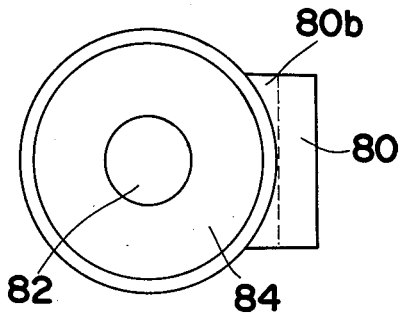
FIG. 13 is a top plan view of the fourth embodiment shown in FIG. 12.

FIGS. 11, 12 and 13 show a fourth embodiment of the present invention in which a substantially U shaped fixed yoke is employed in place of the cylindrical yoke 28 of the respective embodiments described above.

Referring to FIGS. 11 through 13, a fixed yoke 80 consists of a plate member of magnetic material which is bent to assume a substantially U shaped configuration.

The U shaped fixed yoke 80 accomodates the hollow cylindrical bobbin 21 with the excitation coil 22 between opposed top and bottom plate members 80*a* and 80*b*.

A pin 82 having an enlarged disc 83 is fixedly engaged in the top plate member 80*a*. The disc 83 serves to secure the fixed armature 23 and the permanent magnet 26 surrounded by the spacer ring 27 within the enlarged end space of the bobbin 21.

A cylindrical guide yoke 84 made of magnetic material is threadingly secured to the bottom plate member 80*b* and the upper portion of the guide yoke 84 extends up to the lower end portion of the bobbin 21 so as to guide the plunger 20 in a direction axially of the bobbin 21.

A spacer 85 is placed between the bottom plate member 80*b* and the lower end of the bobbin 21 and serves to fix the bobbin 21 onto the U shaped fixed yoke 80.

86*a* and 86*b* are threaded holes for receiving bolts (not shown) necessary to secure the electromagnetic device on a suitable frame member (not shown).

In the electromagnetic device as described above, when and so long as the excitation coil 22 is deenergized, the plunger 20 is attracted onto the fixed armature 23 against the force of the spring 24 by the magnetic force exerted by the permanent magnet 26.

On the other hand, when the excitation coil 22 is energized by a current flowing therethrough, the magnetic flux developed by the permanent magnet 26 is so cancelled by a magnetic flux developed by the excitation coil 22 that the magnetic motive force provided at the fixed armature 23 is weakened. Thus, the plunger 20 is disengaged from the fixed armature 23 and urged away from the fixed armature 23 by the action of the spring 24 until the bottom end of the enlarged portion 25 engages the upper shoulder 84*a* of the guide cylinder 84, and the plunger 20 protrudes out of the fixed yoke 80 in the projected position.

Figure 14:
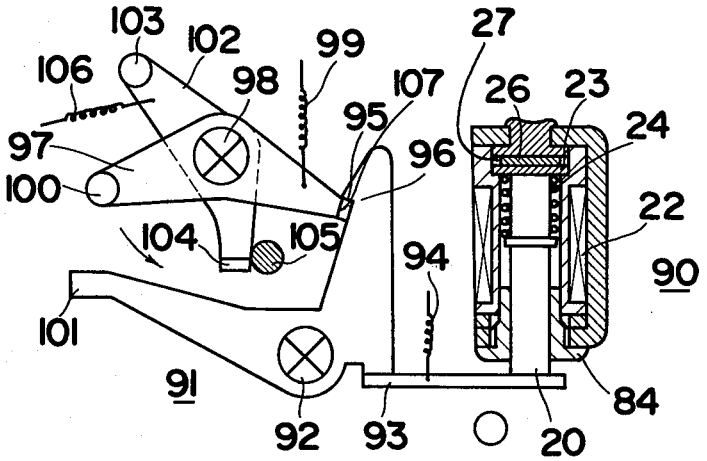
FIG. 14 is a plan view showing an application of the fourth embodiment of the present invention in a camera.

An application of the present invention in a single lens reflex camera is shown in FIG. 14 in which the electromagnetic device shown in the fourth embodiment is employed.

Referring to FIG. 14, an engaging member 91 is pivotably mounted on a pin 92. An end of a first arm 93 of the engaging member 91 is engaged with the free end of the plunger 20 of the electromagnetic device 90. The engaging member 91 is urged counterclockwise by a spring 94 about the pin 92.

A hook 95 provided at the free end of a second arm 96 of the engaging member 91 engages an end of a driving lever 97 urged to rotate counterclockwise about a fixed axis 98 by the action of a spring 99 thereby preventing the further counterclockwise rotation of the driving lever 97. When the excitation coil 22 is energized and the magnetic force of the permanent magnet 26 is cancelled, the plunger 20 is urged away and projects outwards from the fixed armature 23 by the action of the spring 24, thereby causing the engaging member 91 to rotate clockwise against the action of the spring 94.

By this rotation of the engaging member 91, the hook 95 disengages from the lever 97 to allow the latter to rotate counterclockwise by the action of the spring 99.

The driving lever 97 serves to perform a stop-down of a diaphragm, a kick-up operation of a reflex mirror and a release of a leading shutter curtain according to a predetermined program so as to expose a film.

The rotation of the driving lever 97 causes the pin 100, mounted thereon, to engage the third lever 101 of the engaging member 91 to rotate the latter counterclockwise about the pin 92. Thus, the first arm 93 assists the plunger 20 to move to the retracted position against the action of the spring 24, so that the plunger 20 can be attracted onto the fixed armature 23.

Even after the plunger 20 has contacted the fixed armature 23, the pin 100 of the driving lever 97 which is urged counterclockwise by the action of the spring 99 continues to push the third arm 101 of the engaging member 91 to rotate the latter 91 counterclockwise and, in turn, to push the plunger 20 upward. Under such condition, the first arm 93 is resiliently deformed so as to absorb the force produced by the tendency of the engaging member 91 to rotate counterclockwise, thereby preventing the overload acting on the plunger 20.

In order to prevent the overload on the plunger 20, an overcharge mechanism comprising the overcharge spring 53 and overcharge cylinder 50 as shown in FIG. 7 may be employed in the electromagnetic device in place of the resilient first arm 93.

Another embodiment of the overcharge mechanism comprises a position adjustment of the armature 23 as shown in FIG. 9. In this embodiment, the overload of the plunger 20 and any possible damage thereto can be prevented even if the first arm 93 is made of a less resilient material.

Referring again to FIG. 14, a reset lever 102 pivoted on the axis 98 and having a pin 103 on one end and a rising part 104 on the other end is urged to rotate counterclockwise against the action of a spring 106 by means of a pin 105 which shifts leftward with reference to the motion of a film winding lever (not shown). When the reset lever 102 rotates clockwise about the axis 98, the rising part 104 engages the driving lever 97 and serves to rotate the latter clockwise against the action of the spring 99, resulting in the rising part 107 of the driving lever 97 being brought into position ready to engage the hook 95.

The reset member 102 may be arranged in such manner that the reset member is released by way of a shutter close signal from an engaged position set by a stopping member (not shown) and is rotated clockwise by a spring (not shown) so that the reset member 102 serves to rotate the driving lever 97 clockwise to a position at which the rising portion 107 is ready to engage the hook 95. In this arrangement, the spring 106 may be omitted and the reset lever 102 may be rotated counterclockwise simultaneously with the winding up operation of a film by means of a wind up lever (not shown) so as to retain the reset lever 102 in the charged position by engaging against the stopping member (not shown).

Figure 15:
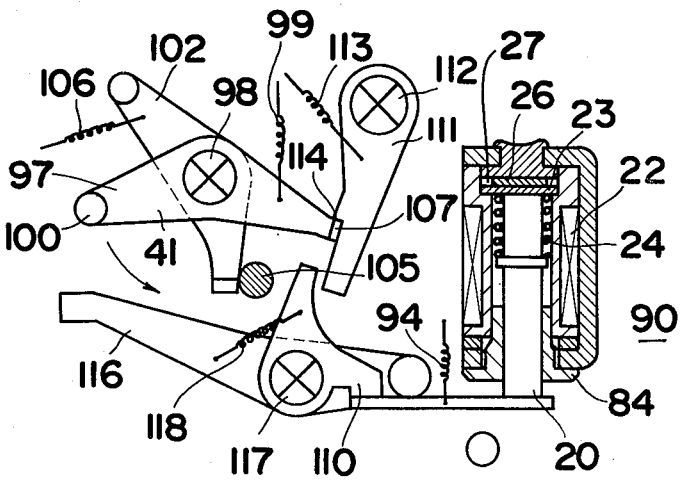
FIG. 15 is a plan view showing another application of the fourth embodiment of the present invention in a camera.

FIG. 15 shows another of the application of the electromagnetic device according to the present invention.

In the arrangement shown in FIG. 15, when the plunger 20 is urged to the projected position by the action of the spring 24 and energizing of the excitation coil 22 by a current flowing therethrough, an intermediate lever 110 rotates clockwise against the action of the spring 94, and a stopping member 111 which is pivotable around an axis 112 is urged to rotate counterclockwise against the action of a spring 113. The rotation of the stopping member 111 releases the engagement between a hook 114 and a rising part 107 of the driving lever 97, which has been retained in the illustrated position by the hook 114. Thus, the driving lever 97 is caused to rotate counterclockwise by the action of the spring 99 and serves to cause the film to be exposed.

On the other hand, the counterclockwise rotation of the driving lever 97 causes the pin 100 mounted thereon to engage a lever 116 pivotable about an axis 117. Since the lever 116 is connected with the intermediate lever 110 by a spring 118 and is mounted on the axis 117 coaxially with the intermediate lever 110, the rotation of the lever 116 causes the intermediate lever 110 to rotate counterclockwise and, in turn, the plunger 20 is moved along the guide yoke 84 to the retracted position where the plunger 20 is magnetically attracted to the fixed armature 23.

The lever 116 is rotatable counterclockwise beyond the position in which the intermediate lever 110 stops at the retracted position of the plunger 20.

This excessive rotation of the lever 110 enables the plunger 20 to be engaged with the fixed armature 23 not only tightly but also resiliently, since the intermediate lever 110 is resiliently urged counterclockwise by the action of the spring 118.

The operation of the reset lever 102 and the spring 106 in this embodiment is similar to that shown in FIG. 14 and, therefore, the details thereof are omitted.

Figure 16:
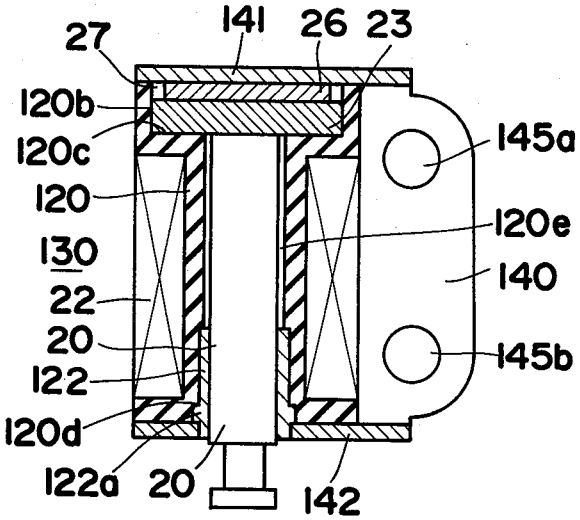
FIG. 16 is a front sectional view showing the fifth embodiment of an electromagnetic device of the present invention.
Figure 17:
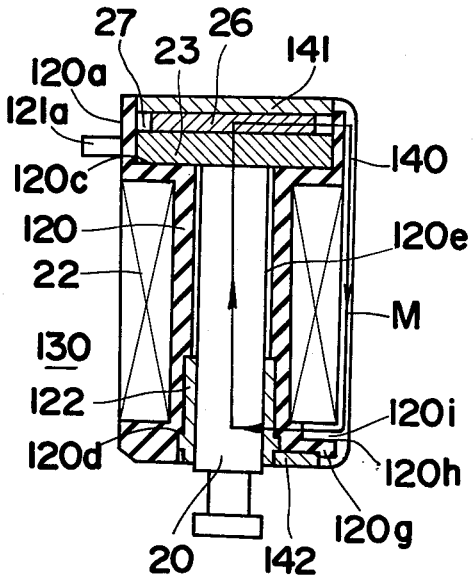
FIG. 17 is a side sectional view showing the fifth embodiment.
Figure 18:
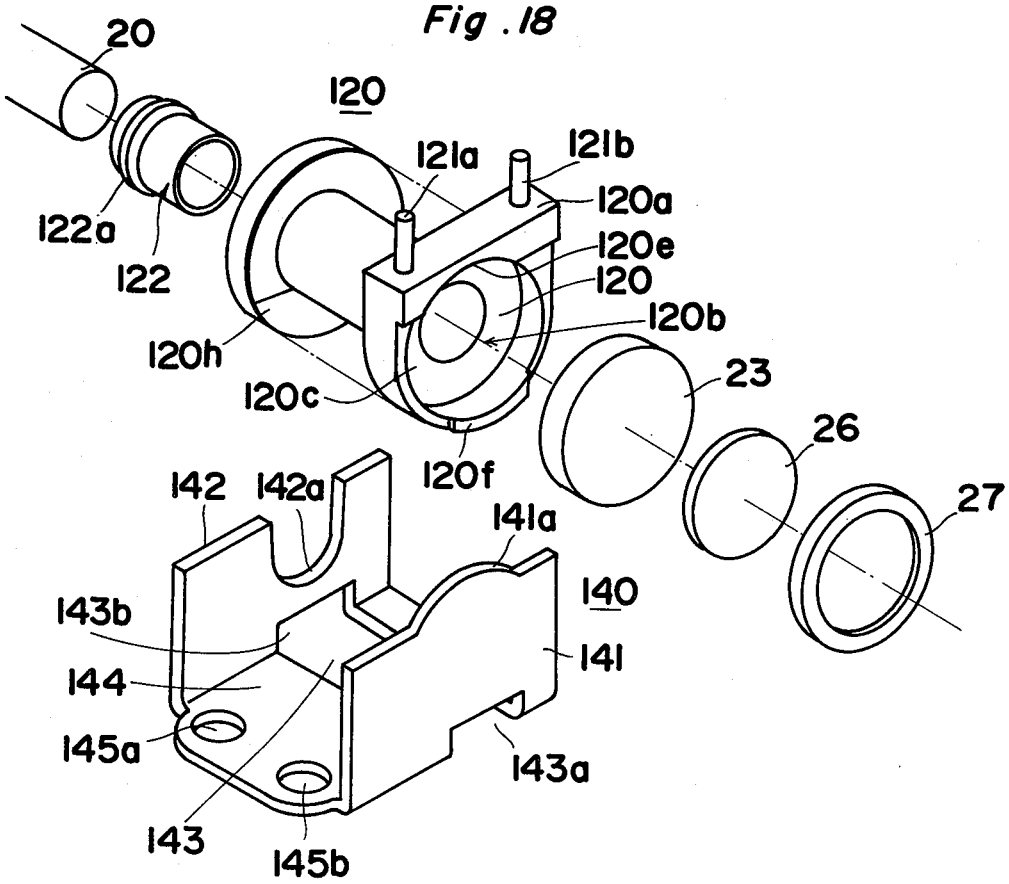
FIG. 18 is an exploded perspective view showing the fifth embodiment.

FIGS. 16 through 18 show the fifth embodiment of the present invention.

The excitation coil 22 is wound on a hollow bobbin 120 made of synthetic resin and the respective free ends of the excitation coil 22 are connected to respective terminal pins **121*a* and 121*b* secured to the end frame 120*a* of the bobbin 120**.

The fixed armature 23 and the permanent magnet 26 surrounded by the spacer ring 27 are placed within the enlarged end space **120*b* of the bobbin 120 and the fixed armature 23 is received by a bottom face 120*c* of the enlarged portion of the bobbin 120**.

A cylindrical guide yoke 122 is engaged in the opening defined in the bottom end of the bobbin 120, and the enlarged rim **122*a* formed on the guide yoke 122 is engaged with the shoulder 120*d* provided at the end of the bobbin 120**.

The plunger 20 is accomodated within the cylindrical hole **120*e* of the bobbin 120 and is arranged to slide in a direction axially of the bobbin 120 along the inner surface of the guide yoke 122 to the upper limit of the stroke where the upper surface of the plunger 20 contacts the fixed armature 23**.

The electromagnetic means 130 arranged in the bobbin 120 as described above, is assembled between the first and second walls 141 and 142 of a U shaped fixed yoke 140 in such a manner that the upper surface of the permanent magnet 26 contacts the inner surface of the first wall 141 and the bottom surface of the bobbin 120 contacts the inner surface of the second wall 142 with the bottom portion of the guide yoke 22 engaged within the arcuate opening **142*a* defined in the second wall 142**.

On the other hand, a shoulder **120*e* of the bobbin 120 having an arcuate portion and flat portions about the side surface 141*a* of the first wall 141 of the fixed yoke 140**.

The bobbin 120 is secured to the fixed yoke 140 by inserting the projections **120*f* and 120*g* (see FIG. 17) formed at both ends of the bobbin 120 into the openings 143*a* and 143*b* respectively, which openings are defined by a slot 143 extending between the corners of the first and second walls 141 and 142 through the side wall 144**.

It is appreciated that when the projection **120*g* is inserted in the opening 143*b*, the thin portion of the end flange 120*h* will be deformed resiliently inwardly by a gap 120*i* defined between the bottom end face of the excitation coil 22 and the flange 120*h*, so that the bobbin 120** is secured tightly to the fixed yoke.

**145*a* and 145*b*** are threaded holes for receiving bolts (not shown) necessary to secure the electromagnetic device on a suitable frame member (not shown).

The operation of the electromagnetic device of this embodiment is similar to that of any one of the embodiments described hereinbefore and, therefore, the details thereof are omitted.

Figure 19:
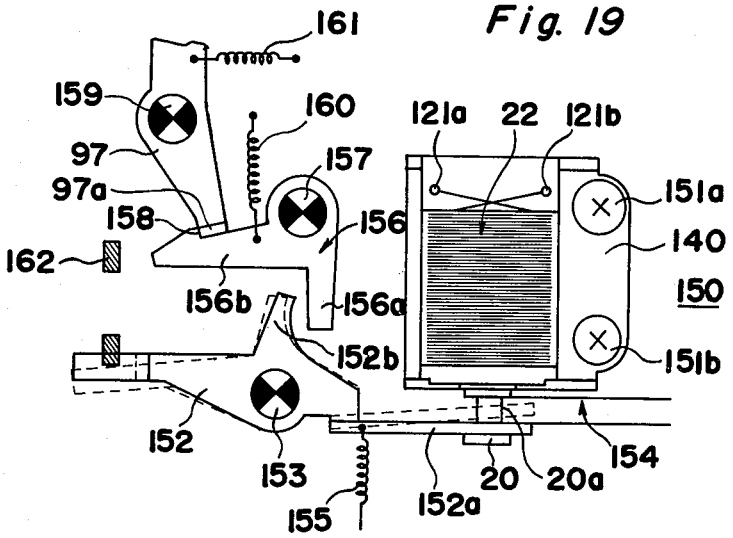
FIG. 19 is a plan view showing an application of the fifth embodiment in a camera.

FIG. 19 shows a further application in a single lens reflex camera of the electromagnetic device 150 according to the fifth embodiment.

The device 150 is fixedly mounted on a suitable stationary frame (not shown) by means of the bolts **151*a*** and 151*b* threadingly engaged in the holes 145*a* and 145*b*.

An overcharge lever 152 is pivotably mounted on an axis 153 and the first resilient arm 152*a* is mounted in a slot 20*a* of the plunger 20 with a play 154. The first arm 152*a* is urged clockwise by a spring 155.

The second arm 152*b* is engageable with the first lever 156*a* of an engaging member 156 pivotably mounted about an axis 157. The second lever 156*b* of the engaging member 156 has a hook 158 at its end which is engaged with a rising part 97*a* of the driving lever 97 pivotable about an axis 159.

The engaging member 156 and the driving lever 97 are urged clockwise by respective springs 160 and 161.

In the arrangement shown in FIG. 19, when the excitation coil 22 is energized by a current applied to the terminal pins 121*a* and 121*b*, the magnetic flux developed by the permanent magnet 26 is so cancelled by a magnetic flux developed by the excitation coil 22 that the magnetic motive force provided at the fixed armature 23 is weakened. Thus, the plunger 20 is disengaged from the fixed armature 23 and urged away from the armature 23 by the action of the spring 155, causing the overcharge lever 152 to rotate clockwise and, in turn, the engaging member 156 is rotated counterclockwise by the second arm 152*b*.

Thus, the hook 158 disengages from the rising part 97*a* of the driving lever 97 to allow the latter to rotate clockwise by the action of the spring 161. The driving lever 97 operates the shutter mechanism of the camera.

When the excitation coil 22 is deenergized, the magnetic flux developed by the permanent magnet 26 flows in the path M defined via the fixed yoke 140, guide yoke 123 and the plunger 20 as shown in FIG. 17, so that the plunger 20 is attracted to the fixed armature 23.

On the other hand, when a reset pin 162 is moved downward to push the overcharge lever 152, the first arm 152*a* is moved to a position as shown by the dotted line, thereby pushing up the plunger 20 so that the plunger 20 can readily be attracted onto the fixed armature 23 as described above.

It is noted that the play 154 provides a mechanism for absorbing an overcharge action caused by an excessive motion of the first arm 152*a*, and allows the arrangement to be manufactured with rather large clearance.

Figure 21:
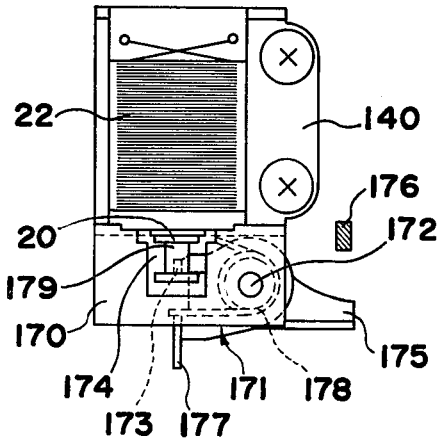
FIG. 21 is a front view showing the sixth embodiment of an electromagnetic device of the present invention.
Figure 20:
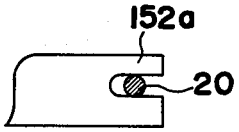
FIG. 20 is a partial diagramatic view showing an end portion of a lever employed in the device shown in FIG. 19.

FIG. 21 shows the sixth embodiment of the present invention in which the overcharge mechanism is integral with the fixed yoke 140.

In this embodiment, a bracket 170 is integral with the fixed yoke 140.

A driving member 171 is pivotably mounted about an axis 172. The driving member 171 comprises an engaging member 173 in the form of a rising part engaged in the slot 174 of the plunger 20, a first arm 175 acted on by a reset pin 176 and a second arm 177 employed for actuating the shutter mechanism of a camera (not shown).

The driving member 171 is urged counterclockwise by a spring 178 constrained between the second arm 177 and the outer surface of the second wall 142 of the fixed yoke 140.

In operation, when the excitation coil 22 is energized and the plunger 20 is released, the plunger 20 is pushed out of the fixed yoke 140 by the effect of the counterclockwise motion of the engaging member 173 of the driving member which has resulted from a biasing force of spring 178 transmitted to said driving member.

When the excitation coil 22 is deenergized and the driving member 171 is rotated clockwise by the reset pin 176 moving downward, the plunger 20 is retracted toward the fixed armature 23.

In this arrangement, the overcharge exerted on the driving member 171 can be absorbed by the play 179 defined in the slot 174.

Figure 22:
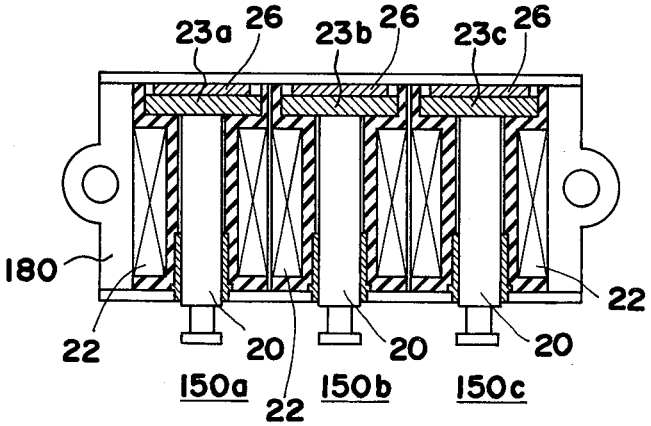
FIG. 22 is a cross sectional view showing the seventh embodiment of an electromagnetic device of the present invention.

FIG. 22 shows the seventh embodiment of an electromagnetic device according to the present invention in which three sets of the electromagnetic devices 150*a*, 150*b* and 150*c* each of which is similar in construction to the electromagnetic device 150 as shown in FIGS. 16 through 18 are mounted side-by-side within an elongated U shaped fixed yoke 180.

In the embodiment of the FIG. 22, respective fixed yokes 23*a*, 23*b* and 23*c* may be replaced by one common elongated fixed yoke covering each of devices 150*a* through 150*c*.

Figure 23:
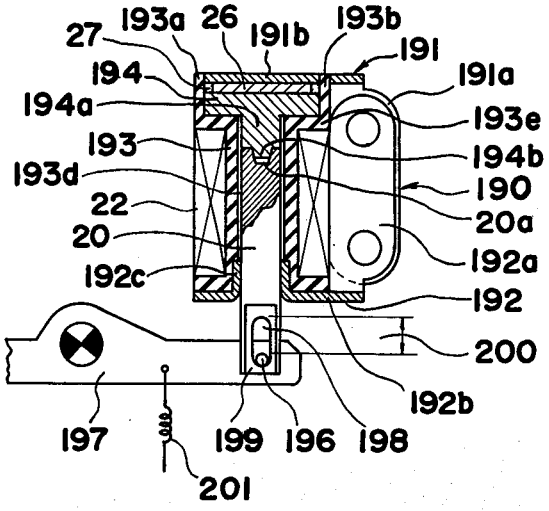
FIG. 23 is a cross sectional view showing the eighth embodiment of an electromagnetic device of the present invention.

FIG. 23 shows the eighth embodiment of the present invention.

In this embodiment, the fixed yoke 190 is composed of two L shaped members 191 and 192 assembled by laying the leg portion 192*a* of one L shaped member 192 above the leg portion 191*a* of another L shaped member 191 so as to constitute a substantially U shaped configuration.

A cylindrical hollow bobbin 193 is accomodated in the fixed yoke 190 and respective projections 193*a* and 193*b* formed on the top of the bobbin 193 are engaged in the holes defined in the wall 191*b* of the L shaped member 191.

On the other hand, the bottom end portion of the bobbin 193 is mounted on a cylindrical projection 192*c* formed in the wall 192*b* of the L shaped member 192 by the use of a burring method or extrusion. Thus, the bobbin 193 is secured to the respective walls 191*a* and 192*a*.

The cylindrical projection 192*c* acts as a guide yoke for the plunger 20 which is slidably inserted in the hollow space of 193*d* of the bobbin 193.

A fixed armature 194 is housed in the end space defined by the enlarged part 193*e* of the bobbin 193 and a short column 194*a* of the fixed armature 194 is inserted in the hollow space 193*d* of the bobbin 193. A small projection 194*b* provided on the bottom face of the short column 194*a* and a recess 20*a* defined in the top portion of the plunger 20 are adapted to engage each other so as to assure the tight engagement of the plunger 20 with the fixed armature 194 when the plunger 20 is attracted onto the fixed armature 194.

The permanent magnet 26 surrounded by the spacer ring 27 is sandwiched between the fixed armature 194 and the wall 191*b*.

The excitation coil 22 is wound around the bobbin 193.

A pin 196 mounted on the lever 197 is engaged in an elongated slot 198 defined in the flat part 199 formed at the end of the plunger 20.

The play 200 defined in the slot 198 serves to absorb the overcharge caused by the excessive motion of the lever 197.

The lever 197 is urged by a spring 201 clockwise so as to move the plunger 20 away from the fixed armature 194 when the excitation coil 22 is energized.

Figure 24:
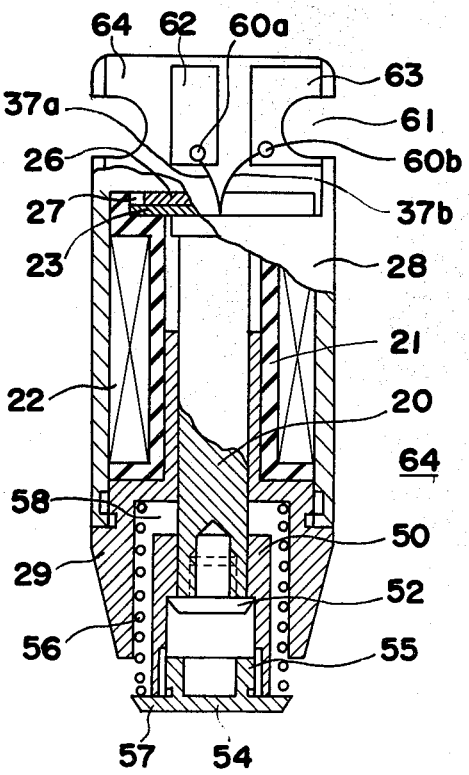
FIG. 24 is a cross sectional view showing the nineth embodiment of an electromagnetic device of the present invention.
Figure 25:
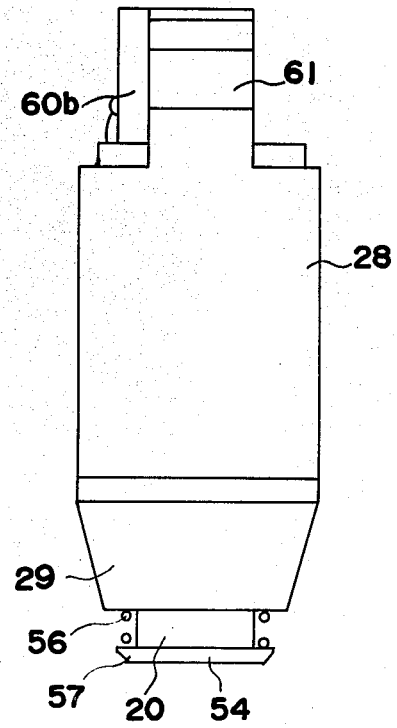
FIG. 25 is a side view showing the nineth embodiment.

FIGS. 24 and 25 show the ninth embodiment of the present invention. This embodiment is a variation of the embodiment shown in FIG. 7, and is similar thereto except that the overcharge spring 53 is omitted and therefore details thereof are omitted.

Figure 26:
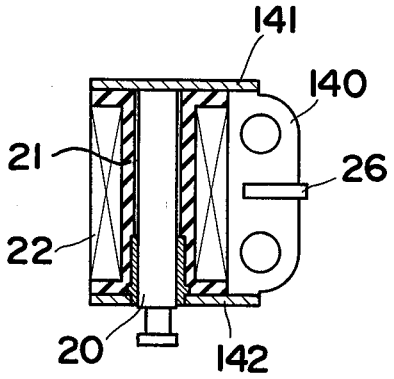
FIG. 26 is a cross sectional view showing the tenth embodiment of the present invention.

FIG. 26 shows the tenth embodiment of the present invention, wherein the permanent magnet 26 is disposed within the U shaped fixed yoke 140 and the top face of the plunger 20 contacts the first wall 141 of the fixed yoke.

Figure 27:
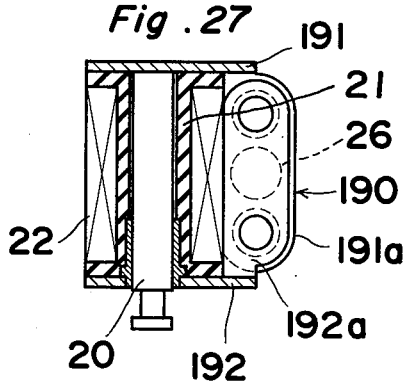
FIG. 27 is a cross sectional view showing the eleventh embodiment of the present invention.

FIG. 27 shows the eleventh embodiment of the present invention, wherein the permanent magnet 26 is disposed between the legs 191*a* and 192*a* of the U shaped plates 191 and 192 which constitute the U shaped yoke 190 as shown in FIG. 23.

Figure 28:
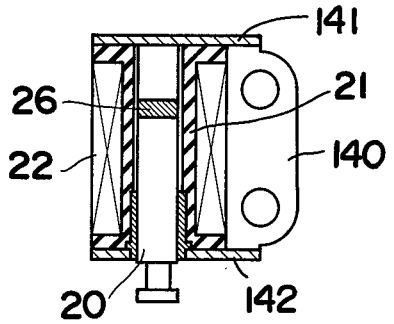
FIG. 28 is a cross sectional view showing the twelveth embodiment of the present invention.

FIG. 28 shows the twelveth embodiment of the present invention, wherein the permanent magnet 26 is disposed in the intermediate portion of the plunger 20.

According to the present invention, since there is used a permanent magnet made from a material of the rare earth group which is able to recover it's high remanence after removal of an applied magnetomotive force of opposite polarity, it makes it possible not only to position the permanent magnet in the magnetic circuit of the excitation coil without a shunt plate but also to use a thin permanent magnet, so that the electromagnetic device can be made compact.

On the other hand, assuming that the electromagnetic device of the present invention is made the same size as that of the conventional one, the use of the thin permanent magnet makes it possible to make the excitation coil longer than the conventional one so as to increase the magnetoforce of the coil, resulting in decreasing the consumption of the electric power of the coil for releasing the armature.

Furthermore, the provision of the thin permanent magnet facilitates passing the magnetic flux produced by the excitation coil through the permanent magnet due to the decrease of the reluctance of the permanent magnet.

In addition, since the contacting surfaces of the plunger and the armature of the electromagnetic device of the present invention are covered by the excitation coil, the contacting surfaces are protected from being damaged by such magnetic powders which intruded in a camera body, for example, during it's manufacture, or which may be produced due to the engagement or abutment between various members of magnetic materials provided in the camera.

What is claimed is:

1. An electromagnetic device comprising yoke means made of a magnetic material and having a working surface;

a plunger made of a magnetic material and having a working surface at its one end, the plunger being movable in an axial direction thereof between first and second positions where the working surface of the plunger is in and out of engagement with the working surface of the yoke means respectively, a permanent magnet magnetically connected between portions of said yoke means, the yoke means and the plunger and the permanent magnet constituting a single closed magnetic circuit passing through the working surface when the plunger is at the first position, the permanent magnet being disposed in the magnetic circuit for generating magnetic flux which passes through the magnetic circuit in a direction for providing a magnetic force of attraction for arresting the plunger at the first position; and an excitation coil at least partially surrounded by the yoke means and wound in a shape having an axially extending hollow space for accommodating therein the plunger, and for generating, upon excitation thereof, magnetic flux which passes through the entire length of the single magnetic circuit, the yoke means closing the end of said hollow space toward which the plunger moves to said first position and the working surface thereof facing into said hollow space, whereby the working surface of the yoke means and the plunger are protected against magnetic powder from outside the device adhering to the working surface of the yoke means and the plunger;

said permanent magnet being made of an intermetallic compound given by the formula $RCo_5$ where R is a member selected from the group consisting of Y and at least one of the rare earth elements, the excitation coil when excited having a polarity for causing the magnetic flux generated by the excitation coil substantially to cancel the flux generated by the permanent magnet at the working surface to thereby reduce the magnetic force of attraction, the permanent magnet having a relatively short distance between its opposite poles for facilitating passage of the magnet flux generated by the excitation coil.

2. An electromagnetic device as claimed in claim 1, further comprising means for urging the plunger towards the projected position.

3. An electromagnetic device as claimed in claim 2, wherein said plunger urging means is positioned externally of the electromagnetic device.

4. An electromagnetic device as claimed in claim 2, wherein said plunger urging means is positioned inside of said yoke means.

5. An electromagnetic device as claimed in claim 1, wherein the yoke means is composed of a cylindrical enclosure.

6. An electromagnetic device as claimed in claim 5, in which said yoke means includes a guide yoke of a magnetic material secured to the cylindrical enclosure to be positioned in the hollow space for allowing the plunger to extend therethrough.

7. An electromagnetic device as claimed in claim 1, wherein the yoke means includes of a substantially U shaped plate having opposite end walls and a side wall interconnecting the end walls.

8. An electromagnetic device as claimed in claim 7, in which said yoke means further include a guide yoke made of a magnetic material positioned for allowing the plunger to extend therethrough and for increasing magnetic permeability between the yoke means and the plunger at a position existing in the magnetic circuit other than the working surface of the yoke means and the plunger.

9. An electromagnetic device as claimed in claim 8, wherein the guide yoke is formed by burring or extruding the U shaped plate as a part of the U shaped plate.

10. An electromagnetic device as claimed in claim 8, wherein the guide yoke is provided seperately from the U shaped plate and secured to the U shaped plate.

11. An electromagnetic device as claimed in claim 6 or 8, further comprising means for urging the plunger towards the projected position.

12. An electromagnetic device as claimed in claim 11, further comprising means for resetting the plunger towards the retracted position against the plunger urging means and means for allowing the over-actuation of the reset means with the plunger held at the retracted position.

13. An electromagnetic device as claimed in claim 12, wherein the plunger and the reset means include portions which are opposed to one another with a given play therebetween for serving as the reset means over-actuation allowing means.

14. An electromagnetic device as claimed in claim 13, wherein one of the portions of the plunger and the reset means is a slot, and the other is a projection loosely fit in the slot.

15. An electromagnetic device as claimed in claim 13, wherein the reset means includes an end as the portion thereof and the plunger includes a cut-away portion whose one wall defines the portion of the plunger, the end of the reset means being in the cut-away portion so as to oppose the wall of the plunger with a given play.

16. An electromagnetic device as claimed in claim 1, further comprising means for absorbing an excessive force exerted on the plunger to move said plunger towards the retracted position.

17. An electromagnetic device as claimed in claim 16, wherein said means for absorbing the excessive force comprise an overcharge cylinder mounted on the plunger for movement along the plunger, an end plug secured to an end portion of the overcharge cylinder and a resilient member constrained between the end portion of the plunger and the end plug.

18. An electromagnetic device as claimed in claim 1, wherein the yoke means includes a yoke member and a fixed yoke piece having the working surface, the permanent magnet being accommodated within the yoke means so as to be disposed in the magnetic circuit at a position between the yoke member and the fixed yoke piece.

19. An electromagnetic device as claimed in claim 18, further comprising a spacer member of a magnetic material disposed around the permanent magnet so as to abut the yoke member and the fixed armature for protection of the permanent magnet.

20. An electromagnetic device as claimed in claim 18, further comprising means for adjusting the position of the fixed yoke piece and the permanent magnet so as to adjust the retracted position of the plunger.

21. An electromagnetic device as claimed in claim 18, further comprising a signal member responsive to the movement of the plunger between the retracted and projected positions, said yoke means including a bracket extending from the yoke member and the signal member being mounted on the bracket.

22. An electromagnetic device as claimed in claim 21, wherein the signal member is commonly used for means for resetting the plunger towards the retracted position.

23. An electromagnetic device as claimed in claim 7, wherein the U shaped fixed yoke consists of two L shaped plates assembled integrally so as to assume a substantially U configuration.

24. An electromagnetic device as claimed in claim 23, wherein one of said L shaped plates comprises a guide cylinder formed by the use of a burring method or an extrusion, said guide cylinder being inserted within an end portion of the hollow space so as to allow the plunger to extend therethrough.

25. An electromagnetic device as claimed in claim 1, further comprising a hollow bobbin around which the excitation coil is wound, said cover means including at least a part of the bobbin.

26. An electromagnetic device as claimed in claim 8, wherein the guide yoke is in contact with one end wall of the U shaped plate.

27. An electromagnetic device as claimed in claim 18, wherein said yoke member is composed of a substantially U shaped plate having opposite end walls and a side wall interconnecting the end walls.

28. An electromagnetic device as claimed in claim 27, wherein the permanent magnet is in contact with one of the end walls of the U shaped plate and the fixed yoke piece.

29. An electromagnetic device as claimed in claim 28, in which said yoke means further comprising a guide yoke made of a magnetic material and having a guide surface for guiding the axial movement of the plunger, the guide yoke being in contact with the other end wall of the U shaped plate to increase magnetic permeability between the plunger and said other end wall of the U shaped plate.

30. An electromagnetic device as claimed in claim 1, wherein the permanent magnet has a shape of a thin plate the opposite surfaces of which in the direction of the thickness form the opposite poles of the permanent magnet.

* * * * *